US009387956B1

(12) United States Patent
Hirshberg

(10) Patent No.: US 9,387,956 B1
(45) Date of Patent: Jul. 12, 2016

(54) APPARATUS TO ENABLE A SPORTS EQUIPMENT BAG TO HANG HORIZONTALLY FROM A CHAIN LINK FENCE

(75) Inventor: Jonathan Hirshberg, Manhattan Beach, CA (US)

(73) Assignee: JR286 Technologies, Inc., Los Angeles, CA (US)

( * ) Notice: Subject to any disclaimer, the term of this patent is extended or adjusted under 35 U.S.C. 154(b) by 2232 days.

(21) Appl. No.: 11/334,067

(22) Filed: Jan. 17, 2006

(51) Int. Cl.
*B65D 33/06* (2006.01)
*A45C 3/00* (2006.01)

(52) U.S. Cl.
CPC ..... *B65D 33/06* (2013.01); *A45C 2003/007* (2013.01)

(58) Field of Classification Search
USPC ..... 224/584, 651, 680; 294/142, 149, 152, 294/157; 206/315.1, 579; D3/221, 256, D3/271.9; 383/20, 24, 16; 220/480; 248/693, 320
See application file for complete search history.

(56) References Cited

U.S. PATENT DOCUMENTS

| | | | | | |
|---|---|---|---|---|---|
| 2,889,863 | A | * | 6/1959 | Arnold, Jr. | 206/315.1 |
| 4,463,789 | A | * | 8/1984 | Leiserson | 383/97 |
| 4,793,532 | A | | 12/1988 | Cash | |
| 4,801,010 | A | | 1/1989 | Levitas | |
| 4,805,749 | A | * | 2/1989 | Gerch | 190/111 |
| 4,890,731 | A | * | 1/1990 | Mroz | 206/315.9 |
| D320,692 | S | * | 10/1991 | Killer | D3/256 |
| 5,407,111 | A | | 4/1995 | Lanouette et al. | |
| 5,425,449 | A | | 6/1995 | Boorady | |
| 5,460,363 | A | | 10/1995 | Tomer | |
| D370,560 | S | * | 6/1996 | Doerbaum | D3/254 |
| 5,562,204 | A | | 10/1996 | Sapyta et al. | |
| 5,845,780 | A | * | 12/1998 | Allen | 206/579 |
| 5,863,088 | A | * | 1/1999 | Kelly et al. | 294/146 |
| 5,878,672 | A | * | 3/1999 | Ostermann et al. | 108/44 |
| 6,039,474 | A | | 3/2000 | DeChant | |
| 6,193,034 | B1 | | 2/2001 | Fournier | |
| 6,196,718 | B1 | | 3/2001 | DeChant | |
| 6,276,501 | B1 | | 8/2001 | Tong | |
| 6,464,098 | B1 | * | 10/2002 | Henson et al. | 220/475 |
| 6,681,936 | B2 | | 1/2004 | Godshaw et al. | |
| D489,898 | S | | 5/2004 | Oberhelman | |
| 6,732,863 | B2 | * | 5/2004 | Speck | 206/315.9 |
| 6,948,599 | B2 | | 9/2005 | Rodrigue | |
| 7,892,064 | B2 | * | 2/2011 | Carruth | 446/73 |
| 2003/0062328 | A1 | | 4/2003 | Millar | |
| 2004/0149600 | A1 | * | 8/2004 | Wolter et al. | 206/223 |
| 2005/0052100 | A1 | * | 3/2005 | Horning | 312/249.13 |
| 2006/0037877 | A1 | * | 2/2006 | Souza | 206/315.1 |
| 2006/0042976 | A1 | * | 3/2006 | Hawthorne | 206/315.1 |
| 2006/0151345 | A1 | * | 7/2006 | Coffing | 206/315.1 |
| 2007/0034546 | A1 | * | 2/2007 | Vosloo | 206/579 |
| 2007/0062995 | A1 | * | 3/2007 | Kasuli et al. | 224/637 |

FOREIGN PATENT DOCUMENTS

| | | |
|---|---|---|
| WO | WO98/52439 | 4/1998 |

* cited by examiner

*Primary Examiner* — Nathan J Newhouse
(74) *Attorney, Agent, or Firm* — Thomas I. Rozsa

(57) ABSTRACT

The present invention is a sports equipment carrying bag which contains internal compartments of conventional design to enable sporting equipment to be retained and carried therein. The unique feature of the present invention is that the carrying bag incorporates two bag retaining members which enable the sports bag to be hung from a fence such as a chain link fence in a manner which enables the bag to be horizontally oriented so that it is much easier to remove items from the bag without the items falling out and much easier to remove baseball bats from the bag so that bats are horizontally removed and it is not necessary to lift the bats out of and over the sports bag when the bag is hung from the chain link fence.

1 Claim, 6 Drawing Sheets

APPARATUS TO ENABLE A SPORTS EQUIPMENT BAG TO HANG HORIZONTALLY FROM A CHAIN LINK FENCE

BACKGROUND OF THE INVENTION

1. Field of the Invention

The present invention relates to the field of bags which are used to retain sporting equipment and in particular equipment used to play the game of baseball and softball, including uniforms, balls, ball catching gloves, and bats. The present invention also relates to the field of sporting bags which can be hung from a chain link fence to facilitate ready access to the equipment retained inside of the bag, both before and during the playing of the baseball game or softball game.

2. Description of the Prior Art

In general, the concept of a bag used to retain sporting equipment for use in games such as baseball and softball is known in the prior art. The following Eighteen (18) patents and published patent applications are relevant to the field of the present invention:

1. U.S. Pat. No. 4,793,532 issued to Dennis R. Cash on Dec. 27, 1988 for "Carrier For Ball Game Items" (hereafter the "Cash patent");

2. U.S. Pat. No. 4,801,010 issued to Miriam S. Levitas on Jan. 31, 1989 for "Garment Bag With Strap To Secure Closure Flap In Bundled Configuration" hereafter the "Levitas patent");

3. U.S. Pat. No. 4,890,731 issued to Edward J. Mroz on Jan. 2, 1990 for "Personal Sports Equipment Carrier" (hereafter the "Mroz patent");

4. U.S. Pat. No. 5,407,111 issued to Alan J. Lanouette et al. on Apr. 18, 1995 for "Sports Accessory Bag With Convertible Suspension Means" (hereafter the "Lanouette patent");

5. U.S. Pat. No. 5,425,449 issued to Charles A. Boorady on Jun. 20, 1995 for "Convertible Bag And A Method For Converting The Bag Between Two Functional Carrying Modes" (hereafter the "Boorady patent");

6. U.S. Pat. No. 5,460,363 issued to Rex F. Tomer on Oct. 24, 1995 for "Sports Utility Accessory" (hereafter the "Tomer patent");

7. U.S. Design Pat. No. Des 370,560 issued to David R. Doerbaum on Jun. 11, 1996 for "Baseball Equipment Bag" (hereafter the "Doerbaum Design patent");

8. U.S. Pat. No. 5,562,204 issued to Rachel T. Sapyta et al. and assigned to Rachel Theora Sapyta on Oct. 8, 1996 for "Foldable Carrying Case" (hereafter the "Sapyta patent");

9. U.S. Pat. No. 6,039,474 issued to Daniel A. DeChant on Mar. 21, 2000 for "Miniature Golf Bag Travel Organizer" (hereafter the "474 DeChant patent");

10. U.S. Pat. No. 6,193,034 B1 issued to Marc Fournier on Feb. 27, 2001 for "Sports Bag" (hereafter the "034 Fournier patent");

11. U.S. Pat. No. 6,196,718 B1 issued to Daniel A. DeChant on Mar. 6, 2001 for "Miniature Golf Bag Travel Organizer" (hereafter the "718 B1 DeChant patent");

12. U.S. Pat. No. 6,276,501 B1 issued to Joy Tong on Aug. 21, 2001 for "Composite Suitcase" (hereafter the "Tong patent");

13. United States Patent Application Publication No. 2003/0062328 A1 issued to Dave Millard on Apr. 3, 2003 for "Sports Equipment Holder" (hereafter the "Millard Published patent application");

14. U.S. Pat. No. 6,681,936 issued to Donald E. Godshaw et al. and assigned to Travel Caddy, Inc. Jan. 27, 2004 for "Cosmetic Utility Kit" (hereafter the "Godshaw patent");

15. U.S. Design Pat. No. D489,898 issued to Ralph C. Oberhelman on May 18, 2004 for "Sports Equipment Bag" (hereafter the "Oberhelman Design patent");

16. U.S. Pat. No. 6,948,599 issued to Kathleen Rodrigue et al. and: assigned to Sports P.A.L. Inc., on Sep. 27, 2005 for "Sports Bag Insert" (hereafter the "Rodrigue patent");

17. PCT Application No. WO 98/52439 issued to Marc Fournier filed on Apr. 9, 1998 for "Sports Bag" (hereafter the "52439 Fournier PCT Application").

18. U.S. Pat. No. 6,732,863 issued to Speck and assigned to Hillerich & Bradsby Co. On May 11, 2004 for "Baseball/Softball Equipment Bag (hereafter the Speck patent").

The Cash patent discloses a carrier for ball game items such as baseball bats. The device is designed to hang from a fence and essentially can be unfolded so that it hangs by two suitable hooks, 70 and 72, so that there is access to the bats. This device discloses the concept of a hanging a bag in the vertical orientation so that the baseball bats can be accessed from the top of the bag by lifting the baseball bats vertically up and over and out of the bag.

The Levitas patent discloses a garment bag with a strap so that it can be carried and permitted to be hung vertically so that access can be achieved to various pockets within the bag.

The Mroz patent is a sports equipment carrier which has openings to permit it to carry one or more baseball bats. Further, the device can be carried by the handle. There is also disclosed two eyelets 28 which permit the sports bag to hang on hooks or nails that may be provided to protrude from a wall so that the equipment carrier 10 and the equipment carried therein can be readily stored when the equipment is not in use. The islets are strictly for storage.

The Lanouette patent is a small sports accessory bag to carry small items but definitely not baseball bats. It discloses suspension loops 16 and 17 which can be used to hang the bag from a horizontal bar such as an exercise apparatus as disclosed in FIG. 3.

The Boorady patent discloses a convertible bag. The bag contains a suspending device 34 which can be used to hang the bag from a hook on a door or wall enabling the loading and unloading of articles 24 from the interior 22 of the carrier 10.

The Tomer patent discloses a sports utility accessory which in its unfolded position can be used as a target for pitching and when in its folded position, used as a light bag to carry a baseball glove and a baseball which is used for pitching. It is essentially a fold over bag configuration which cannot be used to securely carry a baseball bat. The bag can also be hung by hooks as shown in FIG. 4.

The Doerbaum patent discloses a design patent for a baseball equipment bag. It has carrying straps but does not disclose any means by which the bag can be hung from a fence.

The Sapyta patent is a patent for a foldable carrying case which does disclose the concept of being able to hang the bag so that it hangs vertically so that horizontal pockets are exposed for access.

The '474 DeChant patent discloses a golf bag organizer. It can be hung vertically so that it can be accessed from a horizontal opening but the vertical hanging member is just simply hook 70.

The Fournier patent discloses a sports bag but its design enables the entire bag to completely open so that it is a generally flat configuration and then the bag can be hung from hook 12.

The '718 DeChant patent is just a continuation of the previous '474 DeChant patent and has the same disclosure. The organizer is a miniature golf bag. The sidewall of the organizer is re-closable with the slide fastener which has a track that defines a bent U-shape.

The Tong patent discloses a composite suitcase. It discloses drawbars 14 which permit a removable hanging hook 15 to be attached thereto so that the device•can be hung from the hanging hook 15.

The Millard Published patent application discloses a sports equipment holder which as disclosed best in FIG. 19 can be used to hold bats by being attached by horizontal tie members. The hook members 60 permit the sports equipment holder to be hung from a chain link fence.

The Godshaw patent discloses a cosmetic case which has two means by which the case can be hung vertically and one can gain access to the pockets which themselves hang vertically.

The Oberhelman patent is a design patent. It discloses the design and shape of a sports equipment bag. It does show the concept of having clip members but the clip members are attached at the vertical location so that the bag hangs vertically.

The Rodrigue patent discloses a sports bag insert which can be hung vertically by loop member 20 with the compartments exposed.

The PCT Application is PCT application based upon the Fournier patent which was already discussed.

The Speck patent discloses an equipment bag which has pockets for retaining sports equipment and a compartment for retaining a baseball bat. It also discloses a hook by which the sports bag can be retained on a chain link fence by hanging in a vertical orientation. As a result, to remove the baseball bat, the bat must by lifted out of and over the bag.

While the general concept of a sports bag to retain sporting equipment has been disclosed, there is a significant need for an improved bag configuration which enables easier access to the equipment, especially baseball bats, retained within the bag when the bag is hung from a fence.

SUMMARY OF THE INVENTION

The present invention is a sports equipment carrying bag which contains internal compartments of conventional design to enable sporting equipment such as uniforms, a baseball or softball, a catcher's mask, ball catching gloves and baseball or softball bats to be retained and carried therein. The unique feature of the present invention is that the carrying bag incorporates two bag retaining members which enable the sports bag to be hung from a fence such as a chain link fence in a manner which enables the bag to be horizontally oriented so that it is much easier to remove items from the bag without the items falling out and much easier to remove the baseball bats from the bag so that bats are horizontally removed and it is not necessary to lift the bats out of and over the sports bag when the bag is hung from the chain link fence.

It has been discovered, according to the present invention, that if a sports bag contains compartments including an elongated compartment which permits baseball bats to be retained in a horizontal orientation therein when the bag is carried, and the bag further contains means to retain the bag in a horizontal orientation when the bag is hung from a fence such as a chain link fence, then the horizontal orientation enables objects to be more easily removed from the bag and the baseball bats can be horizontally slid out of the bag when the bag is hung in a horizontal orientation, thereby facilitating a much easier removal of the baseball bats than was conventionally known in the prior art.

It has further been discovered, according to the present invention, that if the bag retaining means is comprised of a pair of spaced apart straps which are opened and closed by hook and loop fasteners, then the straps can be fed through links in the chain link fence and securely retained on the fence to enable the bag to be hung in a horizontal orientation; from the chain link fence.

It has additionally been discovered, according to the present invention, that if the straps with hook and loop fasteners thereon are incorporated into the sides of one of the carrying straps of the bag, the attachment is more secure and enables to bag to be more stabile as it is hung in a horizontal orientation from a than link fence.

It has also been discovered, according to the present invention, that if the bag retaining means is comprised of a pair of spaced apart hook and clip members, then the hooks can be inserted onto and through links in the chain link fence and securely retained on the fence through their respective clip members to enable the bag to be hung in a horizontal orientation from the chain link fence.

It has further been discovered, according to the present invention, that if the hook and clip members are respectively incorporated into straps which are connected to the sides of one of the carrying straps of the bag, the attachment is more secure and enables to bag to be more stabile as it is hung in a horizontal orientation from a chain link fence.

It is thereafter an object of the present invention to provide a sports bag which contains compartments including an elongated compartment which permits baseball bats to be retained in a horizontal orientation therein when the bag is carried, and the bag further contains means to retain the bag in a horizontal orientation when the bag is hung from a fence such as a chain link fence, then the horizontal orientation thereby enables objects to be more easily removed from the bag and the baseball bats can be horizontally slid out of the bag when the bag is hung in a horizontal orientation, thereby facilitating a much easier removal of the baseball bats than was conventionally known in the prior art.

It is a further object of the present invention to provide a bag retaining means which is comprised of a pair of spaced apart straps which are opened and closed by hook and loop fasteners, so that the straps can be fed through links in the chain link fence and securely retained on the fence to enable the bag to be hung in a horizontal orientation from the chain link fence.

It is an additional object of the present invention the incorporate the straps with hook and loop fasteners thereon into the sides of one of the carrying straps of the bag, so that the attachment is more secure and enables to bag to be more stabile as it is hung in a horizontal orientation from a chan link fence.

It is also an object of the present invention provide a the bag retaining means which is comprised of a pair of spaced apart hook and clip members so that the hooks can be inserted onto and through links in the chain link fence and securely retained on the fence through their respective clip members to enable the bag to be hung in a horizontal orientation from the chain link fence.

It is a further object of the present invention to respectively incorporate the hook and clip members into straps which are connected to the sides of one of the carrying straps of the bag, so that the attachment is more secure and enables to bag to be more stabile as it is hung in a horizontal orientation from a chain link fence.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
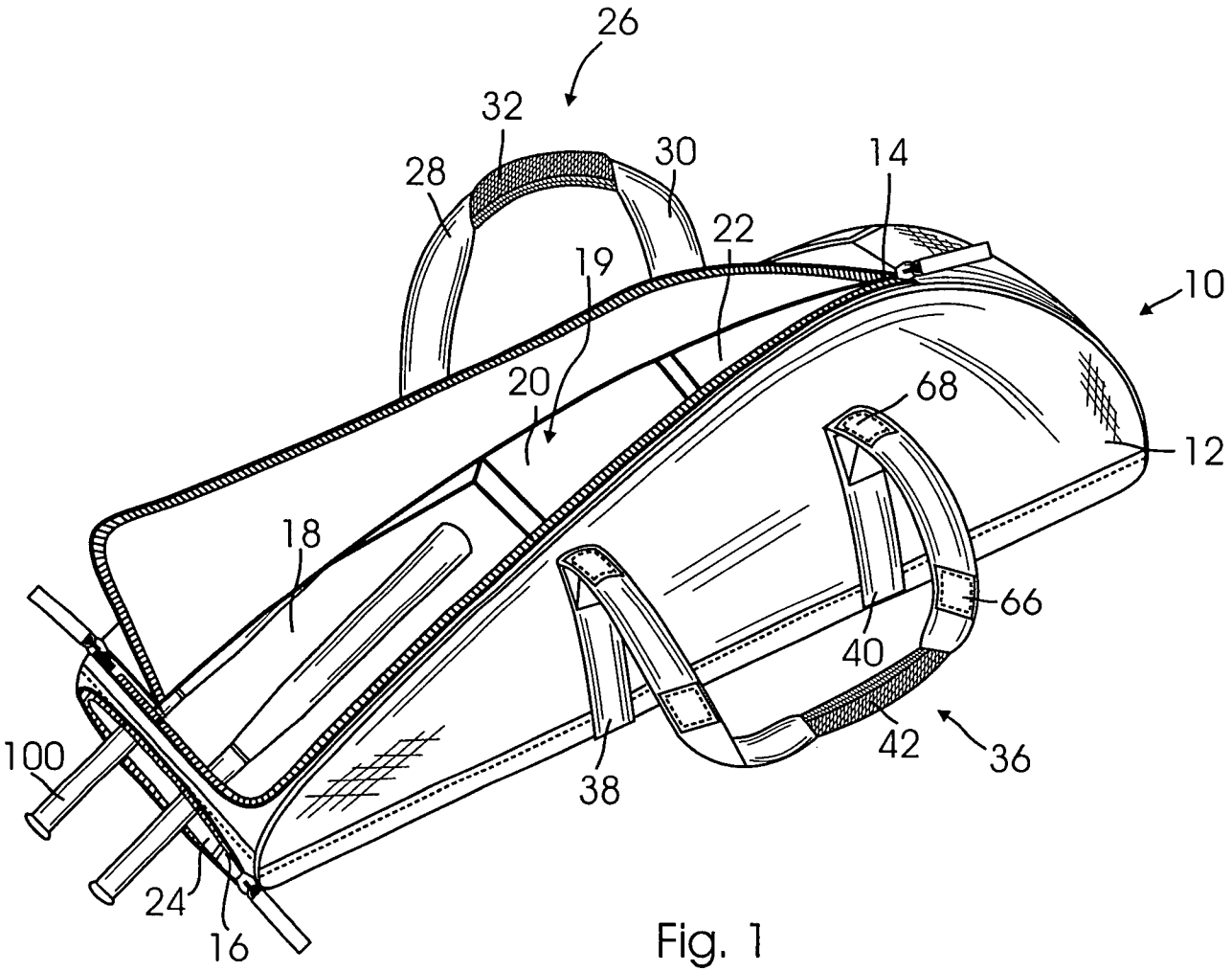
FIG. 1 is a perspective view of the present invention sports bag illustrating one attaching means which is a pair of spaced apart straps to which are attached mating hook and loop fasteners, and also illustrating the bag in the opened condition to disclose compartments for retaining sporting objects such as gloves, baseballs, etc. and illustrating baseball bats retained in a horizontal orientation and hanging out of the bag.

Referring to FIG. 1, there is illustrated at 10 a bag for retaining sports equipment. The bag 10 has an exterior surface 12 which contains at least one opening and closing means 14 such as a zipper. In the embodiment illustrated in FIG. 1, the exterior surface 12 supports two zippers 14 and 16, each leading to an interior compartment within the bag 10. Zipper 14 is in the opened conditioned as illustrated in FIG. 1 (Zipper 14 is in the closed condition in FIG. 2). When opened, zipper 14 leads to an interior chamber 19 which has at least one compartment 20 and preferably a multiplicity of compartments 18, 20 and 22 as illustrated, which can house various sports equipment such as uniforms, a ball catching glove, baseballs, and a catcher's mask. Zipper 16 when in the opening condition as illustrated in FIG. 1 leads to a lower elongated chamber 24 which can house at least one and preferably a multiplicity of baseball bats 100, as illustrated.

The bag 10 is carried by a pair of carrying straps 26 and 36. Carrying strap 26 has a first strap side 28 and a second strap side 30 by which the carrying strap 26 is attached to the exterior surface 12 of the bag 10 by attaching means such as stitching. The first strap side 28 and second strap side 30 each extend to a central grip portion 32. Similarly, carrying strap 36 has a first strap side 38 and a second strap side 40 by which the carrying strap 36, is attached to the exterior surface 12 of the bag 10 by attaching mean such as stitching. The first strap side 38 and second strap side 40 each extend to a central grip portion 42. The bag 10 is carried by pushing the two grip sections 32 and 42 together and carrying the bag with the fingers of one hand surrounding the two gripping sections 32 and 42. It is also possible to have a closing wrap (not shown) which surrounds the two grip section 32 and 42 of handles or carrying straps 26 and 36 to make the bag easier to carry.

Figure 2:
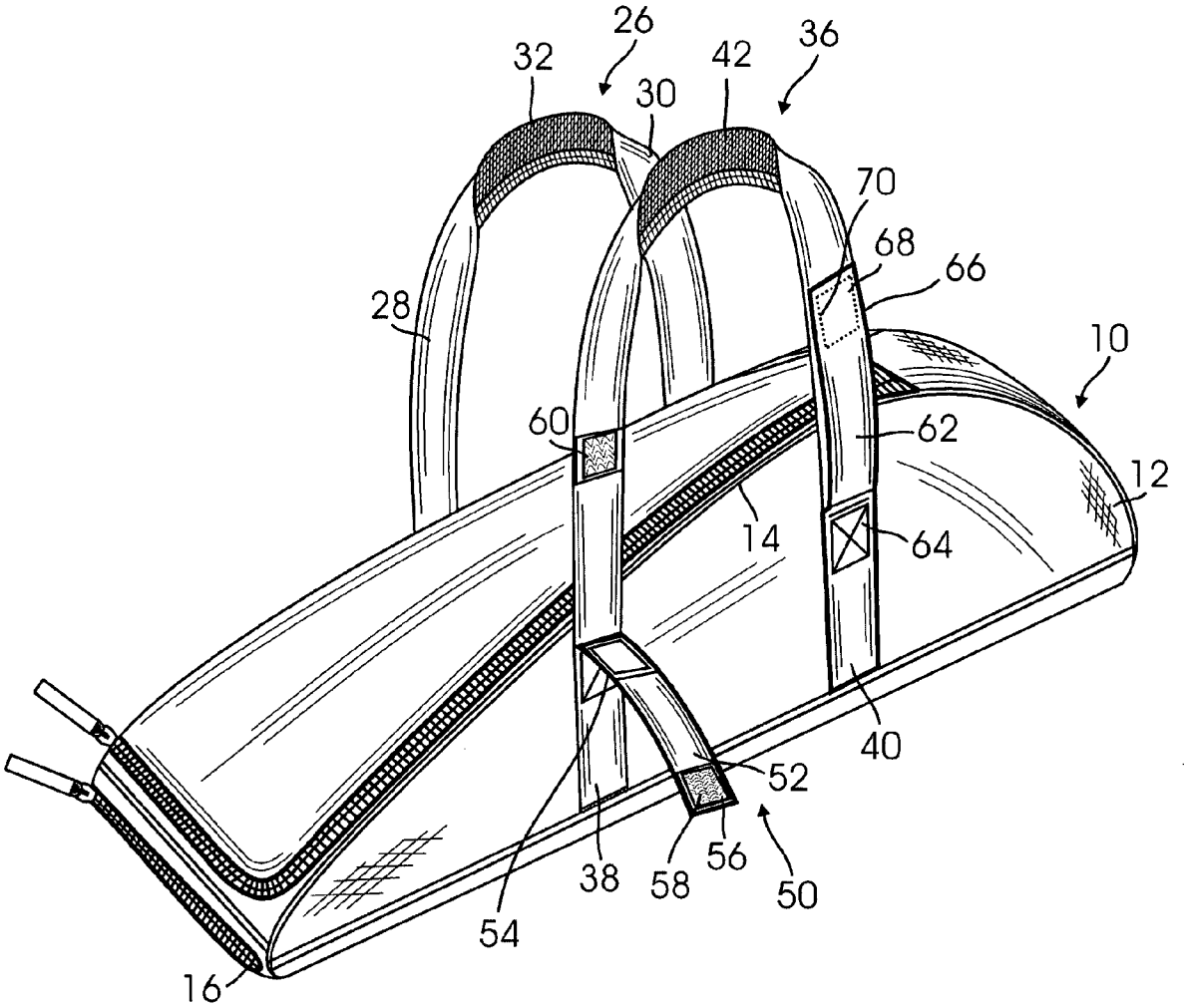
FIG. 2 is a perspective view of the present invention sports bag illustrating one attaching means which is pair of spaced apart straps to which are attached mating hook and loop fasteners, with one strap in the closed condition and one strap in the opened condition, the straps being incorporated into one of the carrying straps of the bag.

The first embodiment of the present invention fence attaching member 50 is illustrated in FIGS. 1 and 2. The attaching member 50 is comprised of a pair of spaced apart straps 52 and 62. Strap 52 is permanently affixed at one end 54 to first strap side 38 of carrying strap 26 by means such as stitching or removably affixed by means of mating fastening members. At its other end 56, strap 52 has one of an attaching means 58, which by way of example can be a hook and loop fastener known as Velcro®. A mating attaching means 60, which by way of example can be a mating hook and loop fastener known as Velcro®, is positioned at a location on the first strap side 38 remote from where the strap 52 is affixed to the first strap side 38. In place of hook and loop, the fastening means can be mating snap fasteners or any other connecting means well known in the art. Strap 62 is permanently affixed at one end 64 to second strap side 40 of carrying strap 36 by means such as stitching or removably affixed by means of mating fastening members. At its other end 66, strap 62 has one of an attaching means 68, which by way of example can be a hook and loop fastener known as Velcro®. A mating attaching means 70, which by way of example can be a mating hook and loop fastener known as Velcro®, is positioned at a location on the second strap side 40 remote from where the strap 62 is affixed to the second strap side 40. In place of hook and loop, the fastening means can be mating snap fasteners or any other connecting means well known in the art.

Figure 3:
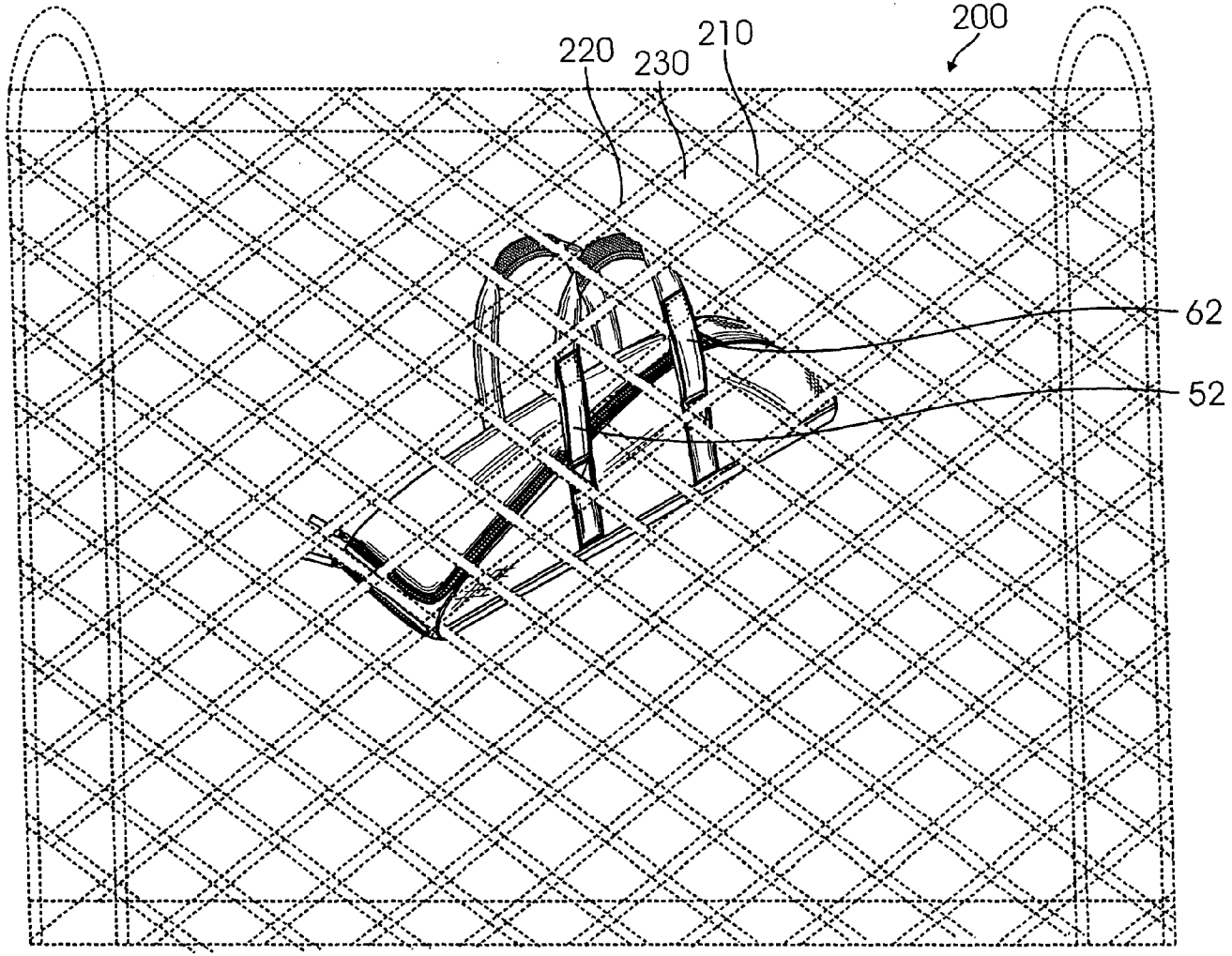
FIG. 3 is a perspective view of the present invention sports bag illustrating one attaching means which is pair of spaced apart straps to which are attached mating hook and loop fasteners, the straps being incorporated into one of the carrying straps of the bag, the straps being fed through links in a chain link fence and respectively closed by their mating hook and loop fasteners to thereby retain the bag in a horizontal orientation on the chain link fence.

Referring to FIG. 3, the bag 10 is shown attached to a chain link fence 200. The chain line fence 200 has a multiplicity of links 210 extending in one direction and a multiplicity of cross-links 220 extending in the opposite direction to form a multiplicity of open spaces 230 between links 210 and cross-links 220. Strap 52 is opened and fed through at least one crossed set of links 210 and cross-links 220 and thereafter closed by mating attaching means 58 and 60. Similarly, strap 62 is opened and fed through at least one crossed set of links 210 and cross-links 220 and thereafter closed by mating attaching means 68 and 70. As a result, bag 10 is held on the fence 200 in a horizontal orientation. This orientation makes the bag much easier to open and remove its contents than conventional sports bags known in the prior art which are vertically oriented. In particular, baseball bats are horizontally oriented and therefore, instead of having to lift the bat up vertically and raise it over the bag 10, all that is necessary is to horizontally slide the bat out, a much easier and safer removal technique. It is possible to have the bag 10 attached to the fence 200 with only one attaching assembly 52 or 62 and its associated attaching means 58 and 60 or 68 and 70 but the bag will then not hang perfectly horizontally.

The straps 52 and 62 of the attaching means 58 and 68 have been illustrated as attached to a portion of a carrying straps 26 and 36. It will be appreciated that it is also within the spirit and scope of the present invention to have the straps 52 and 62 directly attached to the exterior surface 12 of the bag 10 instead of to a portion of a carrying straps. In that case, the mating attaching means 60 and 70 would be on a carrying strap or on a separate strap which aligns two attaching means together, or on another portion of the sports bag 10.

Figure 4:
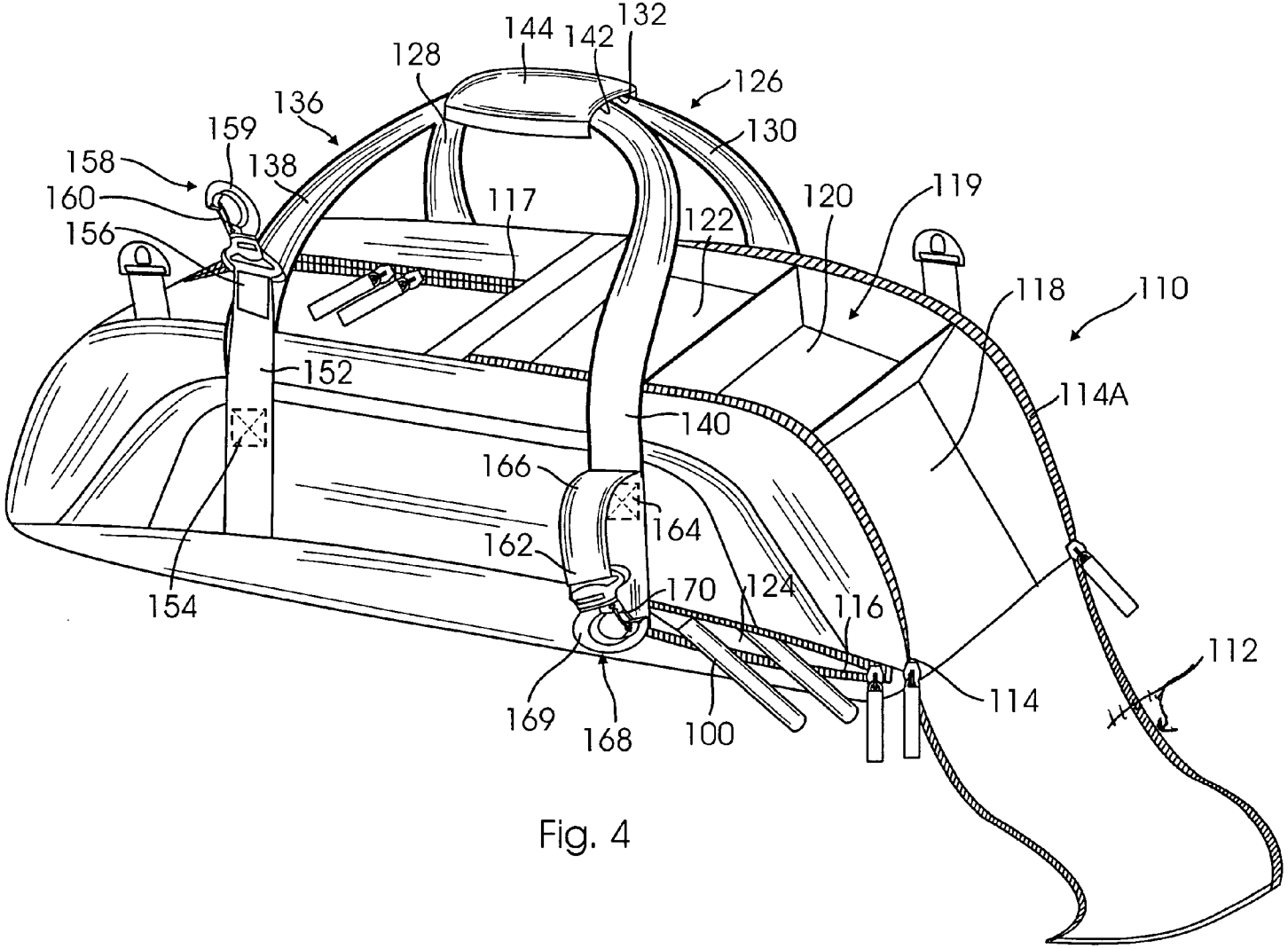
FIG. 4 is a perspective view of another embodiment of the present invention sports bag illustrating an alternative attaching means which is a pair of spaced apart hook and clip members, and also illustrating the bag in the opened condition to disclose compartments for retaining sporting objects such as gloves, baseballs, etc. and illustrating baseball bats retained in a horizontal orientation and hanging out of the bag.
Figure 5:
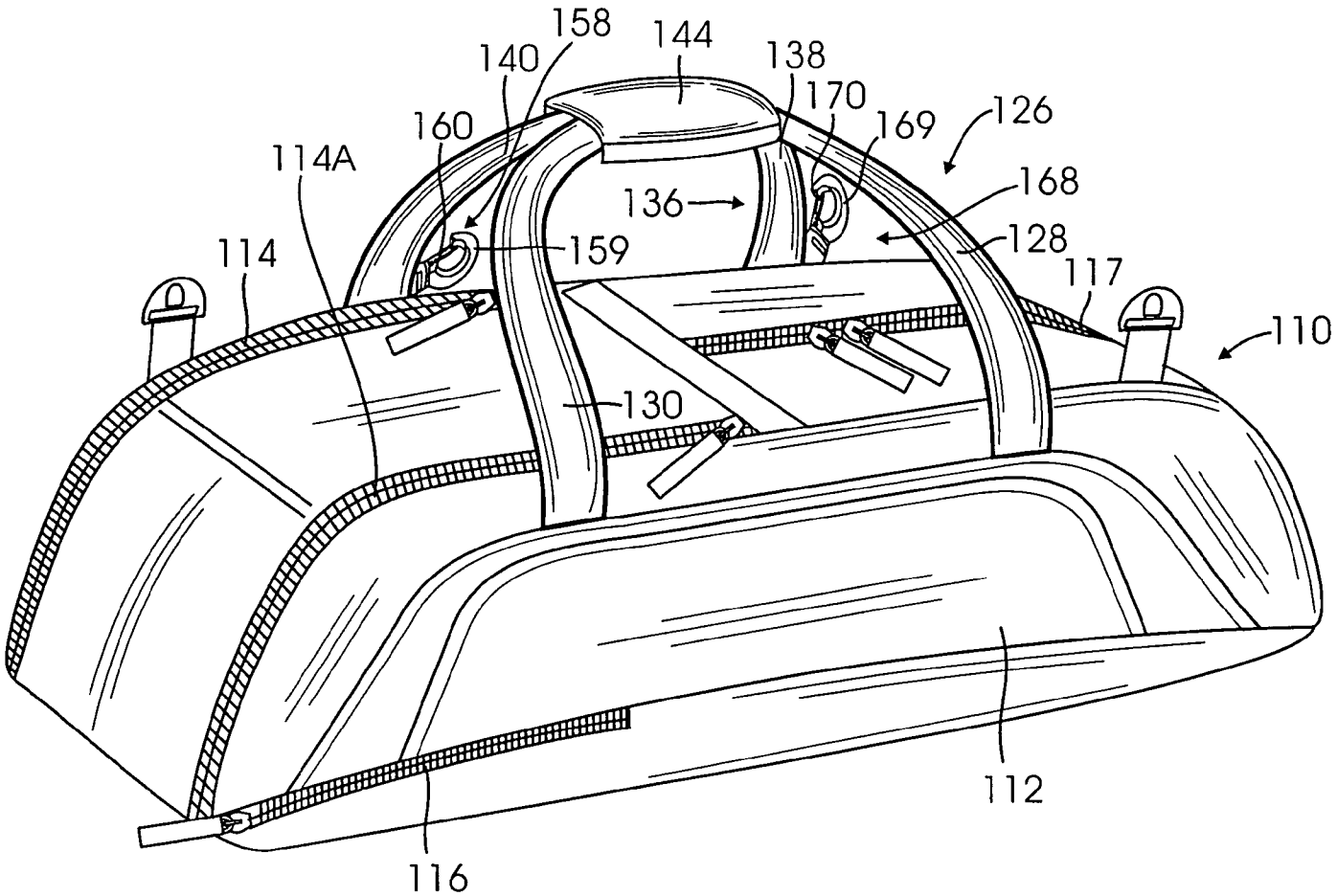
FIG. 5 is a perspective view of the present invention sports bag illustrating the alternative attaching means which is pair of spaced apart hook and clip members, the hook and clip members being incorporated into one of the carrying straps of the bag.

Referring to FIG. 4, there is illustrated at 110 an alternative embodiment of a bag for retaining sports equipment. The bag 110 has an exterior surface 112 which contains at least one opening and closing means 114 such as a zipper. In the embodiment illustrated in FIG. 4, the exterior surface 4 supports four zippers, a pair of oppositely disposed zippers 114 and 114A and a third zipper 116, and a fourth zipper 117. Zippers 114 and 114*a* lead to an interior compartment within bag 110 and zipper 117 leads to the same or another interior compartment within the bag 110. Zippers 114 and 114A are in the opened conditioned as illustrated in FIG. 4 and zipper 117 is in the closed condition. In FIG. 5, zippers 114 and 114*a* are in the closed condition. As illustrated in FIG. 4, when opened, zippers 114 and 114*a* lead to an interior chamber 119 which has at least one compartment 120 and preferably a multiplicity of compartments 118, 120 and 122 as illustrated, which can house various sports equipment such as uniforms, a ball catching glove, baseballs, and a catcher's mask. Zipper 116 when in the opened condition as illustrated in FIG. 4 leads to a lower elongated chamber 124 which can house at least one and preferably a multiplicity of baseball bats 100, as illustrated.

The bag 110 is carried by a pair of carrying straps 126 and 136. Carrying strap 126 has a first strap side 128 and a second strap side 130 by which the carrying strap 126 is permanently attached to the exterior surface 112 of the bag 110 by attaching mean such as stitching or removably attached by mating fastening members. The first strap side 128 and second strap side 130 each extend to a central grip portion 132. Similarly, carrying strap 136 has a first strap side 138 and a second strap side 140 by which the carrying strap 136 is permanently attached to the exterior surface 112 of the bag 110 by attaching means such as stitching or removably attached by mating fastening members. The first strap side 138 and second strap side 140 each extend to a central grip portion 142. The bag 110 is carried by pushing the two grip sections 132 and 142 together and carrying the bag with the fingers of one hand surrounding the two gripping sections 132 and 142. It is also possible to have a closing wrap 144 which surrounds the two grip section 132 and 142 of handles or carrying straps 126 and 136 to make the bag easier to carry.

The second alternative embodiment of the present invention fence attaching member 150 is illustrated in FIGS. 4 and 5. The attaching member 150 is comprised of a pair of spaced apart straps 152 and 162. Strap 152 is permanently affixed at one end 154 to first strap side 138 of carrying strap 126 by means such as stitching or removably affixed by mating fastening means. At its other end 156, strap 152 has one of an attaching means 158, which by way of example can be a hook 159 with a closing clip 160. Strap 162 is permanently affixed at one end 164 to second strap side 140 of carrying strap-136 by means such as stitching or removably affixed by mating fastening means. At its other end 166, strap 162 has an attaching means 168, which by way of example can be a hook 169 with a closing clip 170.

Figure 6:
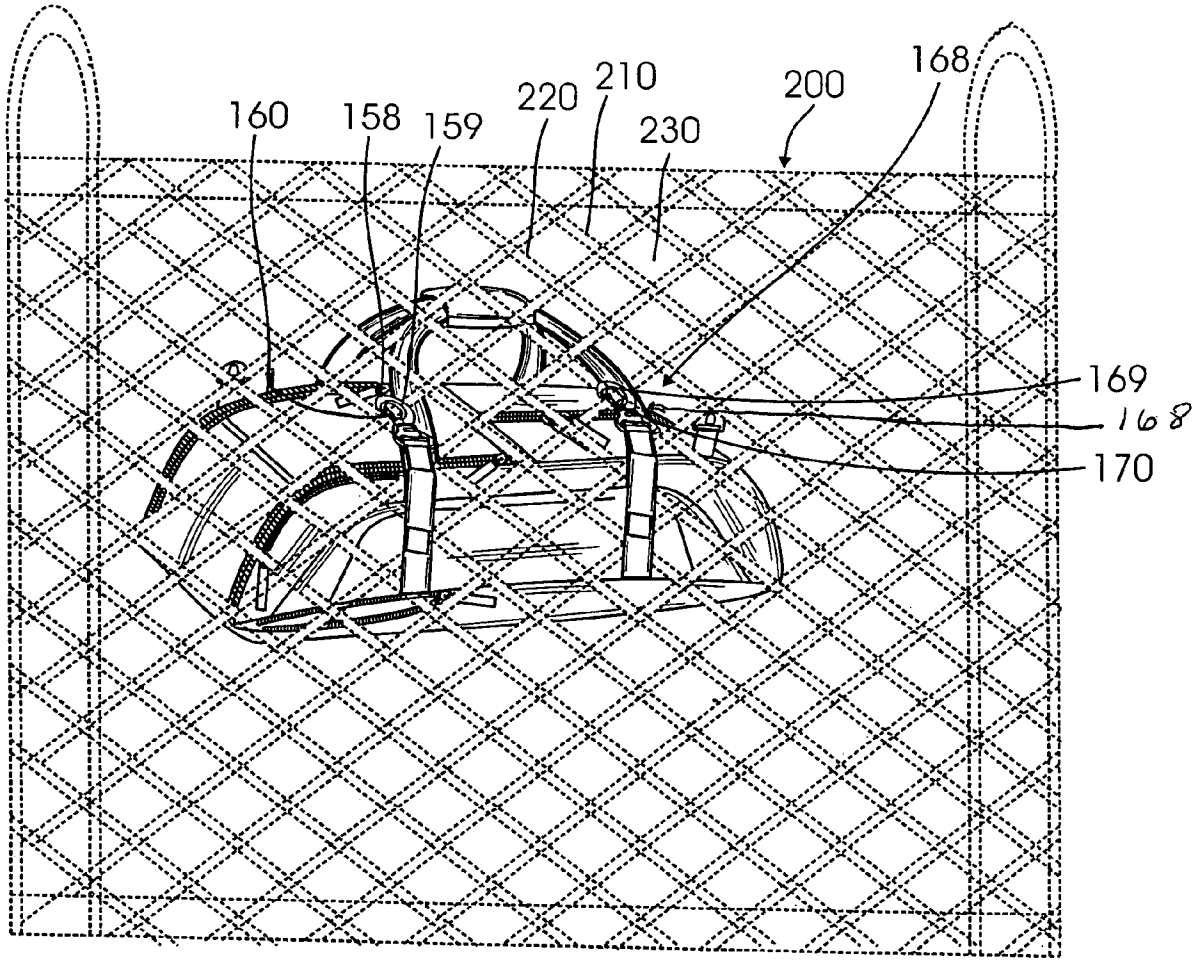
FIG. 6 is a perspective view of the present invention sports bag illustrating one attaching means which is pair of straps to which are respectively attached mating hook and clip members, the straps being incorporated into one of the carrying straps of the bag, the hooks being fed through links in a chain link fence and respectively closed by their mating clip members to thereby retain the bag in a horizontal orientation on the chain link fence.

Referring to FIG. 6, the bag 110 is shown attached to a chain link fence 200. The chain line fence 200 has a multiplicity of links 210 extending in one direction and a multiplicity of cross-links 220 extending in the opposite direction to form a multiplicity of open spaces 230 between links 210 and cross-links 220. The hook assembly 158 is clipped onto the fence 200 at the intersection of at least one set of links 210 and cross-links 220 by snapping the hook 159 over the cross-links and closing it with the closing clip 160. Similarly, the hook assembly 158 is clipped onto the fence 200 at the intersection of at least one set of links 210 and cross-links 220 by snapping the hook 169 over the cross-links and closing it with the closing clip 170. This orientation makes the bag much easier to open and remove its contents than conventional sports bags known in the prior art which are vertically oriented. In particular, baseball bats are horizontally oriented and therefore, instead of having to lift the bat up vertically and raise it over the bag 110, all that is necessary is to horizontally slide the bat out, a much easier and safer removal technique. It is possible to have the bag 110 attached to the fence 200 with only one hook assembly 158 or 168 but the bag will then not hang perfectly horizontally.

The straps 152 and 162 of the hook assemblies 158 and 168 and•their associated hook and closing clip 159 and 160, and 169 and 170 have been illustrated as attached to a portion of a carrying strap 126 and 136. It will be appreciated that it is also within the spirit and scope of the present invention to have the straps 152 and 162 directly attached to the exterior surface 112 of the bag 110 instead of to a portion of a carrying strap, or attached to another portion of the carrying bag 10:

The bags 10 and 110 have been illustrated only to show representative examples of sports bags with which the present invention novel attaching means have been incorporated. It will be appreciated that the present invention novel attaching means which enables the sports equipment bag to be attached to a fence and hang in a horizontal orientation can be incorporated into any multiplicity of differently designed sports bags. In addition, the facts that the first attaching means 50 was illustrated with bag 10 should not be interpreted to limit this attaching means to bag 10. Attaching means 50 can be used with alternative bag 110 or any other sports bag. Similarly, the fact that attaching means 150 was illustrated with alternative bag 110 should not be interpreted to limit this attached means to sports bag 110. Attaching means 110 can be used with bag 10 or any other sports bag.

Defined in detail, the present invention is a sports equipment bag to be hung from a chain link fence having a given vertical height and having a multiplicity of links extending in one direction, a multiplicity of cross-links extending in the opposite direction, and open spaces between the intersections of adjacent links and cross-links, the invention comprising: (a) a sports equipment bag having an exterior surface surrounding at least one interior compartment with means to gain access to the at least one interior compartment, the at least one interior compartment having sufficient length to house at least one bat, the bag having at least a first carrying strap having a first strap side of a given length, a second strap side of a given length and a central gripping portion; (b) a first elongated strap having a first end and a second end, the first elongated strap attached to the first strap side at a location adjacent the first end of the first elongated strap and having an attaching means on the first elongated strap adjacent its second end, a mating attaching means located on the first strap side and aligned with the attaching means on the first elongated strap; and (c) a second elongated strap having a first end and a second end, the second elongated strap attached to the second strap side at a location adjacent the first end of the second elongated strap and having an attaching means on the second elongated strap adjacent its second end, a mating attaching means located on the second strap side and aligned with the attaching means on the second elongated strap; (d) whereby the sports bag is hung from the chain link fence by opening said first elongated strap at the location of the mating attaching means and feeding the first elongated strap through at least one opening in the chain link fence and closing the attaching means, and opening said second elongated strap at the location of the mating attaching means and feeding the second elongated strap through at least one opening in the chain link fence and closing the attaching means, with both elongated straps affixed at the same vertical height to the chain link fence so that the sports bag hangs horizontally on the chain link fence and after the at least one compartment is opened, the at least one bat can be removed from the sports bag through a horizontal motion.

Defined broadly, the present invention is a sports equipment bag to be hung from a chain link fence having a given vertical height and having a multiplicity of links extending in one direction, a multiplicity of cross-links extending in the opposite direction, and open spaces between the intersections of adjacent links and cross-links, the invention comprising: (a) a sports equipment bag having an exterior surface surrounding at least one interior compartment with means to gain access to the at least one interior compartment, the at least one interior compartment having sufficient length to house at least one bat, the sports bag having means to enable the sports bag to be carried; (b) a first elongated strap having a first end and a second end, the first elongated strap attached to the sports bag at a location adjacent the first end of the first elongated strap and having an attaching means on the first elongated strap adjacent its second end, a mating attaching means located on a portion of the sports bag; and (c) a second elongated strap having a first end and a second end, the second elongated strap attached to the sports bag at a location adjacent the first end of the second elongated strap and having an attaching means on the second elongated strap adjacent its second end, a mating attaching means located on a portion of the sports bag; (d) whereby the sports bag is hung from the chain link fence by opening said first elongated strap at the location of the mating attaching means and feeding the first elongated strap through at least one opening in the chain link fence and closing the attaching means, and opening said second elongated strap at the location of the mating attaching means and feeding the second elongated strap through at least one opening in the chain link fence and closing the attaching means, with both elongated straps affixed at the same vertical height to the chain link fence so that the sports bag hangs horizontally on the chain link fence and after the at least one compartment is opened, the at least one bat can be removed from the sports bag through a horizontal motion.

Defined more broadly, the present invention is a sports equipment bag to be hung from a chain link fence having a given vertical height and having a multiplicity of links extending in one direction, a multiplicity of cross-links extending in the opposite direction, and open spaces between the intersections of adjacent links and cross-links, the invention comprising: (a) a sports equipment bag having an exterior surface surrounding at least one interior compartment with means to gain access to the at least one interior compartment, the at least one interior compartment having sufficient length to house at least one bat, the bag having at least a first carrying strap having a first strap side of a given length, a second strap side of a given length and a central gripping portion; (b) a first elongated strap having a first end and a second end, the first elongated strap attached to the first strap side at a location adjacent the first end of the first elongated strap and having a first attaching means on the first elongated strap adjacent its second end; and (c) a second elongated strap having a first end and a second end, the second elongated strap attached to the second strap side at a location adjacent the first end of the second elongated strap and having a second attaching means on the second elongated strap adjacent its second end; (d) whereby the sports bag is hung from the chain link fence by attaching the first attaching means onto at least one link on the fence and attaching the second attaching means onto at least one link on the fence, with both attaching means affixed at the same vertical height to the chain link fence so that the sports bag hangs horizontally on the chain link fence and after the at least one compartment is opened, the at least one bat can be removed from the sports bag through a horizontal motion.

Defined even more broadly, the present invention is a sports equipment bag to be hung from a chain link fence having a given vertical height and having a multiplicity of links extending in one direction, a multiplicity of cross-links extending in the opposite direction, and open spaces between the intersections of adjacent links and cross-links, the invention comprising: (a) a sports equipment bag having an exterior surface surrounding at least one interior compartment with means to gain access to the at least one interior compartment, the at least one interior compartment having sufficient length to house at least one bat, the sports bag having means to enable the sports bag to be carried; (b) a first elongated strap having a first end and a second end, the first elongated strap attached to the sports bag at a location adjacent the first end of the first elongated strap and having an attaching means on the first elongated strap adjacent its second end; and (c) a second elongated strap having a first end and a second end, the second elongated strap attached to the sports bag at a location adjacent the first end of the second elongated strap and having an attaching means on the second elongated strap adjacent its second end; (d) whereby the sports bag is hung from the chain link fence by attaching the first attaching means onto at least one link on the fence and attaching the second attaching means onto at least one link on the fence, with both attaching means affixed at the same vertical height to the chain link fence so that the sports bag hangs horizontally on the chain link fence and after the at least one compartment is opened, the at least one bat can be removed from the sports bag through a horizontal motion.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A sports equipment bag to be hung from a chain link fence having a given vertical height and having a multiplicity of links extending in one direction, a multiplicity of cross-links extending in the opposite direction, and open spaces between the intersections of adjacent links and cross-links, the invention comprising:

a. a sports equipment bag having a distorted cuboid shaped body having at least one openable and closable surface, wherein the body is surrounding at least one interior compartment with means to gain access to the at least one interior compartment, the at least one interior compartment having sufficient length to house at least one bat, the bag having at least a first carrying strap having a first strap side of a given length including a bottom end, a second strap side of a given length including a bottom end and a central gripping portion;

b. a first elongated strap having a first end and a second end, the first elongated strap removably affixed to the first strap side at a location wherein the first end of the first elongated strap is positioned adjacent the bottom end of the first strap side, the first elongated strap having an attaching means adjacent its second end;

c. a second elongated strap having a first end and a second end, the second elongated strap removably affixed to the second strap side at a location wherein the first end of the second elongated strap is positioned adjacent the bottom end of the first strap side, the second elongated strap having an attaching means adjacent its second end; and d. the sports bag is used in conjunction with a chain link fence to be hung from the chain link fence by attaching the first attaching means onto at least one link on the fence and attaching the second attaching means onto at least one link on the fence, with both attaching means affixed at the same vertical height to the chain link fence so that the sports bag hangs horizontally on the chain link fence and after the at least one surface is opened, the at least one bat can be removed from the body of the sports bag through a horizontal motion.

* * * * *